United States Patent [19]

Kosters

[11] 4,426,278

[45] Jan. 17, 1984

[54] PROCESS AND APPARATUS FOR THERMALLY CRACKING HYDROCARBONS

[75] Inventor: Peter H. Kosters, Magrette, Netherlands

[73] Assignee: The Dow Chemical Company, Midland, Mich.

[21] Appl. No.: 405,212

[22] Filed: Aug. 4, 1982

[51] Int. Cl.[3] ..... C10G 9/14; C10G 9/36; C07C 4/04

[52] U.S. Cl. ..... 208/130; 208/132; 585/652

[58] Field of Search ..... 208/132, 130; 585/648, 585/652

[56] References Cited

U.S. PATENT DOCUMENTS 1,853,753 4/1932 Wagner ..... 208/132
1,887,155 11/1932 Harnsberger ..... 208/132
3,154,386 10/1964 Lefren ..... 208/130
3,291,573 12/1966 Frescoln ..... 585/648

*Primary Examiner*—Delbert E. Gantz
*Assistant Examiner*—Lange Johnson
*Attorney, Agent, or Firm*—V. Dean Clausen

[57] ABSTRACT

A process and apparatus capable of cracking hydrocarbon to produce a reaction product containing a high proportion of ethylene. A hydrocarbon such as naphtha is vaporized and admixed with superheated steam at high temperature in a mixing device. The resulting hydrocarbon-steam mixture is passed through a reaction zone consisting of a reactor conduit which extends through a passageway defined in a radiation block structure. Heating gases at extremely high temperatures are directed through the passageway, co-currently with the hydrocarbon-steam mixture, to produce a desirable heat flux for the cracking reaction. A short residence time in the reactor conduit is maintained to prevent undesirable side reactions.

7 Claims, 8 Drawing Figures

PROCESS AND APPARATUS FOR THERMALLY CRACKING HYDROCARBONS

BACKGROUND OF THE INVENTION

The invention relates to a process and apparatus for thermally cracking hydrocarbons. The apparatus includes a steam superheater, a device for mixing the hydrocarbon feed with superheated steam, and a radiation block structure, in which the steam is superheated and in which the cracking reaction takes place.

In the art of thermally cracking hydrocarbons to produce olefins and diolefins, such as ethylene, propylene, butadiene, and the like, experience has shown that certain operating conditions will improve the product yield. These conditions include operating with relatively short residence times and relatively high reaction temperatures, while decreasing the partial pressures of the hydrocarbons in the reaction zone (reactor tubes). Only limited success has been achieved in the systems now being used to crack hydrocarbons.

In conventional cracking systems, the cracking reaction takes place in a cluster of individually suspended tubes, positioned within a large firebox. Such a furnace may require over 100 burners, which are usually mounted on the walls of the fire box, to transfer sufficient heat through the reactor tubes to the hydrocarbon. There are several disadvantages in such a system. One disadvantage is that all of the reactor tubes are exposed to the same flue gas temperature. This means that the maximum heat flux which can be achieved is limited by the maximum temperature at which metal breakdown of the reactor tubes generally occurs. In addition to damaging the reactor tubes, overheating can cause undesirable reactions, such as the formation of an excessively high methane content in the final product. Also, overheating causes an increase in the build-up of coke deposits on the inside of the reactor tubes.

For the reasons described above, the average heat flux over the length of the reactor tubes must be relatively low. To keep the average heat flux at a low level, the reactor tubes in a conventional cracking furnace are, of necessity, from about 50 to 100 meters in length. The long reactor tubes are not desirable because the residence time of the hydrocarbon in the reaction zone is much longer than is required for optimum cracking conditions, and the pressure drop through each tube is undesirably high.

Another process for cracking hydrocarbons, referred to as a partial oxidation-thermal cracking process, is described in U.S. Pat. No. 4,134,824. In this process, crude oil is distilled to separate the asphaltic components. The distillate is then cracked, using partial combustion gases from a methane-oil burner to generate ethylene and other products, with recycling of the asphaltic components to the burner, as fuel for the burner. Major drawbacks of this process include the necessity for separating pitch, carbon dioxide, carbon monoxide, and hydrogen sulfide from the final product.

Another procedure for cracking hydrocarbons is described in U.S. Pat. No. 4,264,435. In this process, a hydrocarbon fuel and oxygen are partially burned, at high temperatures, to generate combustion gases which contain carbon monoxide. Superheated steam is then injected into the combustion gases in a shift reaction zone, to produce hydrogen and to convert some of the carbon monoxide to carbon dioxide. The hydrocarbon feed is then injected into this mixture, in a cracking zone at a temperature of from 600° to 1500° C., to produce a reaction product which contains a relatively high proportion of ethylene.

This process also has several disadvantages, for example, it requires mixing tars and heavy fuel oils with oxygen to generate the burner flame for the cracking reaction. Because the cracking reaction takes place in the flame, the heavier hydrocarbons are mixed with the hydrocarbon in the cracking zone and the final product thus contains undesirable products such as methane. In addition, this process is a fully "adiabatic" operation, in which heat for the cracking reaction is supplied only by the partially burned carrier gases and steam. To supply enough heat for the reaction, the gases must be heated to very high temperatures (over 1600° C.) and the ratio of carrier gases to the hydrocarbon must, of necessity, be high.

SUMMARY OF THE INVENTION

In the process of this invention, the hydrocarbon composition is mixed with superheated steam and the resulting mixture is passed through a reactor conduit which extends through and is enclosed by a radiation block structure. The enclosure defines a gas passage in the radiation block structure which surrounds the reactor conduit. The hydrocarbon-steam mixture is then heated by flowing a heating gas, in contact with the reactor conduit, through the gas passage in a direction co-current with the flow of the hydrocarbon-steam mixture. As the heated mixture passes through the reactor conduit, the cracking reaction takes place. From the reactor conduit the hot reaction product is passed into a heat exchanger for quenching and recovery downstream from the heat exchanger.

The apparatus of the invention includes a means for producing the superheated steam, and a mixing device for mixing the hydrocarbon with the superheated steam. In addition, the apparatus includes the reactor conduit enclosed in the radiation block structure, and the heat exchanger, as described above.

DESCRIPTION OF THE PREFERRED EMBODIMENTS

Figure 1:
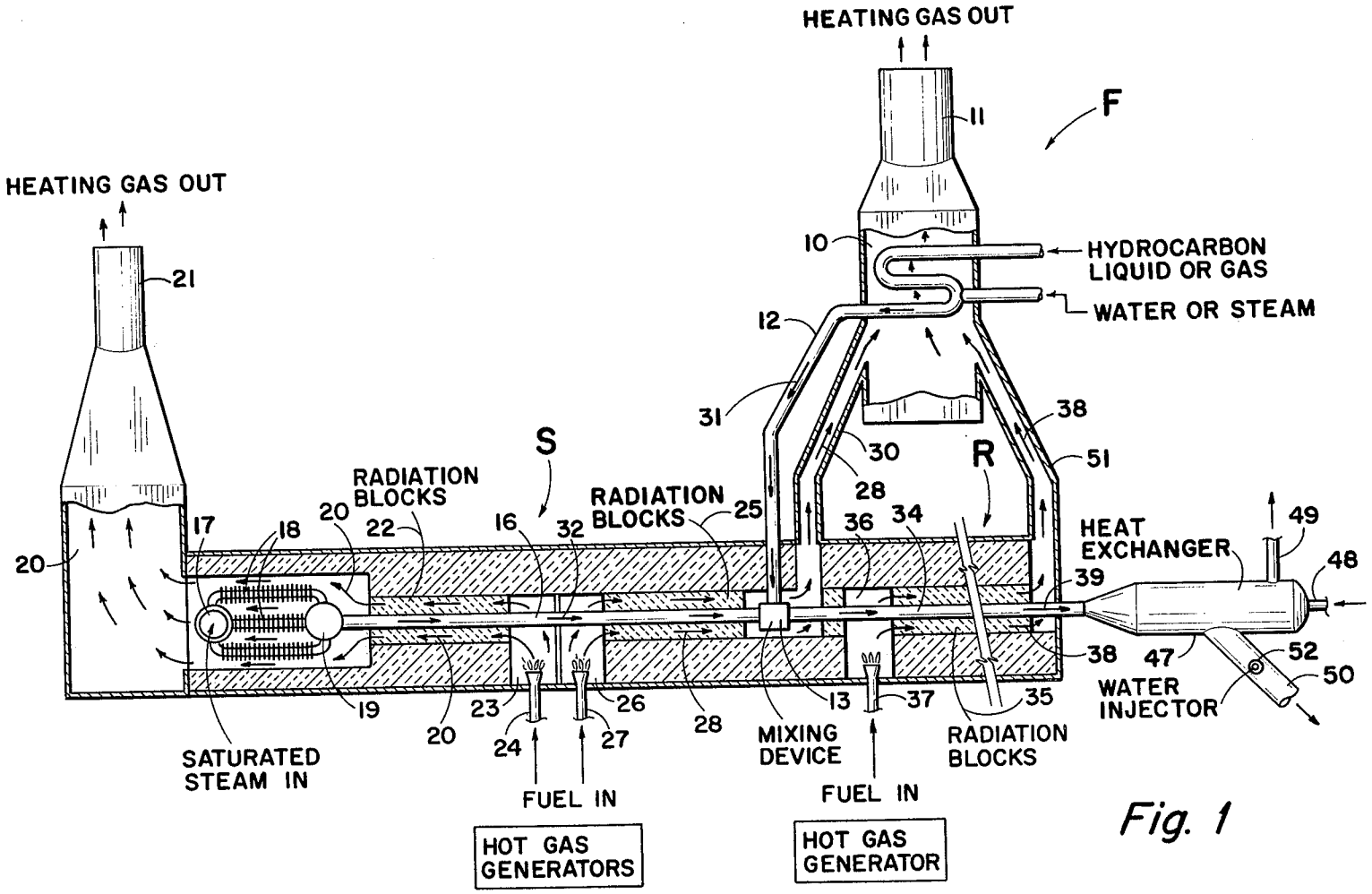
FIG. 1 is a schematic view, mostly in section, of one embodiment of the hydrocarbon cracking apparatus of this invention.

In the drawing, referring particularly to FIG. 1, is illustrated one embodiment of the hydrocarbon cracking apparatus of this invention. The various components of this apparatus include a heat recovery section F, a steam superheater S, and a reaction zone R. The heat recovery section F is optional, but it is preferred in the practice of this invention. The steam superheater section S includes a steam conduit 16, which carries superheated steam to a mixing device 13, in which it is mixed with the hydrocarbon feed. At the feed end of steam line 16 there is a first header 17, for receiving steam at a relatively low temperature. From header 17, the steam is distributed through a group of convection heat conduits 18 (three of these heat conduits are shown in FIG. 1). To more effectively transfer heat to the steam in the convection heat conduits 18, each of the conduits 18 has a number of fin members which are fitted to the outside of the conduit. From conduits 18, the superheated steam flows through a second header 19 and into steam line 16, as indicated by numeral 32.

As shown in FIG. 1, two heating zones are employed to heat the steam in its flow through line 16 toward mixing device 13. In a first zone, the steam line 16 is positioned inside a passage defined within a radiation block structure 22. One end of the passage opens into a chamber 23, to provide for the flow of heating gas, for example, hot combustion or flue gas, to flow from a burner nozzle 24 through the radiation block structure 22. The heating gas flows in a direction countercurrent to the steam in line 16, as indicated by the flow path 20. Upon exiting from radiation block structure 22, the heating gases flow over and around the convection heat conduits 18 and are then discharged through stack 21. The gas flow path is indicated by numeral 20.

In a second heating zone, the steam line 16 is positioned inside the passage provided in a similar radiation block structure 25. The radiation block structure 25 opens into another chamber 26, such that the chamber is located at the opposite end of the block structure from mixing device 13. In the second zone, heating gas from a burner nozzle 27 flows through chamber 26 and the passageway in the radiation block structure, in a direction which is co-current with the flow of the steam in line 16, as indicated by numeral 28. In this heating sequence, the heating gas is at its maximum temperature when the steam is at relatively low temperature, and the temperature of the heating gas gradually decreases as the temperature of the steam increases. This arrangement allows an optimum heat flux to be maintained without overheating the steam line. From the radiation block structure 25, the heating gases pass through a duct 30 into the convection section 10 and are thereafter discharged through stack 11.

A hydrocarbon feed line 12, which carries the hydrocarbon to the mixing device 13, passes through the convection section 10. Prior to mixing the hydrocarbon with the superheated steam, it is generally preferred to pre-heat the hydrocarbon in the convection section 10. The pre-heat temperature and other conditions are such that the hydrocarbon is converted to a vapor or fine mist without significant cracking of the hydrocarbon feed. If the hydrocarbon feed is already in gaseous form, pre-heating is not required to convert it to a vapor or fine mist, but instead, it serves merely as a means of energy recovery. When unsaturated or very heavy hydrocarbons are to be cracked, it is preferred not to pre-heat the hydrocarbon feed.

It is optional, but preferred, to mix the hydrocarbon feed with water or steam prior to or during the preheating step. In actual practice, it is preferred to mix the hydrocarbon with liquid water prior to preheating. As illustrated in FIG. 1, it is preferred to pre-heat the hydrocarbon feed with the same hot gases which are used in heating the superheated steam and the reaction mixture to their respective desired temperatures. Numeral 31 indicates the flow path of the hydrocarbon as it passes through the convection section 10 and into the mixing device 13. Inside of mixing device 13, the hydrocarbon is mixed with the superheated steam.

The hydrocarbon is cracked in the reaction zone R of this apparatus. The components of the reaction zone are a reactor conduit 34, which extends through a radiation block structure 35, preferably in a horizontal position. The radiation block structure 35 opens into a chamber 36 at the end of the block structure which is nearest to the mixing device 13. It is preferred to have the chamber 36 very close to the mixing device.

In operation, the mixture of hydrocarbon and superheated steam passes from the mixing device 13 into the reactor conduit 34, as indicated by numeral 39. As the hydrocarbon/superheated steam mixture leaves the mixing device 13, the cracking reactions start immediately and proceed at a high rate. Because these pyrolysis reactions exhibit a strong endothermicity, there is an immediate temperature decrease in the reacting mixture. This temperature decrease makes it possible to supply heat with a very high flux at the inlet of the reactor tube. For this reason, the mixture of hydrocarbon and superheated steam is passed, preferably immediately upon mixing, through chamber 36. From a burner 37, the heating gases 38 flow through the chamber 36 and through a passageway in the radiation block structure in a direction co-current to the flow of the hydrocarbon/superheated steam mixture through reactor conduit 34.

As the reacting mixture flows through the reactor tube, the reaction rates, as well as the heat uptake, diminish. The reduction in the temperature of the heating gas, as it flows through the radiation block structure co-currently to the flow of the hydrocarbon, results in a corresponding reduction of the heat flux along the entire length of the reactor conduit. This feature of the present apparatus provides optimum heat flux without the possibility of overheating the structural material of the reactor conduit. This mode of operation can be defined as "continuous profile firing". The heat flux can also be partially controlled by varying the size of the interior surface of the radiation blocks, that is, making them larger or smaller.

From the reactor conduit 34, the reaction product is discharged directly into a primary heat exchanger 47, in which it is rapidly cooled. In the cooling step, the hot reaction product passes through the shell side of the heat exchanger and makes indirect contact with a lower temperature fluid, preferably water, which is passed through the tube side of the exchanger. The lower temperature fluid enters the exchanger through inlet 48 and exits though outlet 49. From the exchanger 47, the cooled product is passed through a product outlet conduit 50 and is thereafter recovered. As an optional procedure, the product may be passed from the outlet conduit 50 through one or more additional heat exchangers to further cool it and to condense the steam in the product stream.

In a typical process for cracking a hydrocarbon feed, as illustrated in FIG. 1, the hydrocarbon is mixed with water or steam and then pre-heated to a desired temperature, generally from 300° to 700° C., as it passes through the feed line 12 in convection section 10. The amount of steam or water to be admixed with the hydrocarbon feed, and the temperature to which the mixture is pre-heated, is dependent on the composition of the feed. In general, when the feed consists of light hydrocarbons, for example, a hydrocarbon feed containing primarily hydrocarbons of 5 or less carbon atoms, little or no water, preferably less than about 20 percent by weight, based on the weight of the hydrocarbon, is added; and the mixture is preheated to approximately 500°-700° C. When heavy hydrocarbons are employed as the feed composition, for example, a hydrocarbon feed containing primarily hydrocarbons of 6 or more carbon atoms, water is added, preferably at about 10-70 percent by weight based on the weight of the hydrocarbon; and the mixture is pre-heated to approximately 300°-500° C.

At the pre-heat temperatures described above, which are generally low enough to prevent significant cracking reactions, the hydrocarbon is typically a vapor, or it exists as fine droplets of hydrocarbon dispersed in steam (indicated herein as a mist). As mentioned earlier, the desired pre-heat temperatures are obtained by using the same heating gases employed to heat the superheated steam and the reaction mixture. These gases, which move upwardly through the convection section 10 and are discharged through stack 11, typically have a temperature of from about 1000° to 1200° C.

Steam generally enters header 17 at from 100° to 200° C. and an absolute pressure of from 1 to 12 atmospheres, preferably 2 to 5 atmospheres. As the steam passes through the convection heat conduits 18 and reaches header 19, the heating gases 20, which are moving countercurrently to the steam, at a temperature of from about 600°-1000° C., preferably from 700°-900° C., add further heat, so that the steam in the second header 19 is generally at about 400°-600° C. The steam pressure at this point is generally from about 0.8 to 10 atmospheres, so that it is slightly less than the steam pressure at header 17. At chamber 23, the heating gas temperature is generally from 1400°-2000° C., and preferably from 1500°-1700° C. The higher temperatures are generally employed when the steam conduit is made of a ceramic material. As the heating gas 20 moves in a counter-current flow to the steam in conduit 16, through the first heating zone of the steam superheater S, between header 19 and chamber 23, its temperature gradually drops to from about 600° to about 1000° C. at header 19; and to from about 150° to 250° C., as it passes through the stack 21. The transfer of heat to the steam causes the steam temperature to rise from about 700° C. to 1000° C. at chamber 23.

At chamber 26, the temperaure of the heating gas is generally from 1400° to 2000° C., and preferably from 1500° to 1700° C. As the heating gas 28 moves co-currently with the superheated steam in line 16 through the second heating zone of the steam superheater S, between chamber 26 and mixing device 13, the temperature generally drops to from 1000° to 1700° C. at the mixing device 13, and the steam is further heated to from 1000° to 1500° C. Since steam temperatures of about 1000° C. often result in slow reaction rates and steam temperatures of about 1500° C. result in relatively higher amounts of acetylene formation, the preferred steam temperature is from about 1100°-1400° C. At the mixing device 13, the steam pressure is from about 0.8 to 5.0 atmospheres, more typically from 1 to 3 atmospheres. The length of the steam line 16 should be about 30 meters or less. The shorter the steam line, the smaller is the pressure drop.

In mixing device 13, the pre-heated hydrocarbon is admixed with the superheated steam. In general, the temperature and amount of superheated steam employed raise the temperature of the hydrocarbon to from 700°-1000° C. This rise in temperature, which is caused by an almost instantaneous mixing of the hydrocarbon with the superheated steam from steam line 16, enables the cracking rection to start at the very instant the reaction mixture enters the front end of the reactor conduit 34. After the hydrocarbon is mixed with the superheated steam, preferably immediately after mixing occurs, the mixture is heated by gases from burner 37. Typically, these heating gases will have a temperature of from about 1700°-2000° C., and preferably from about 1750°-1850° C. The superheated steam/hydrocarbon mixture moves rapidly through conduit 34.

The desired residence time of the reaction product in conduit 34 depends on a variety of factors, such as the composition of the hydrocarbon feed, the reaction (cracking) temperaures and the desired reaction products. Generally, the residence time for a heavy hydrocarbon feed in the reaction zone, that is from mixing device to heat exchanger, should be from about 0.005 to 0.15 seconds, and preferably from about 0.01 to 0.08 seconds. For a light hydrocarbon, the preferred residence time in the reactor conduit is from about 0.03 to 0.15 seconds.

As the heating gas 38 moves through the radiation block structure 35, co-currently to the hydrocarbon/-superheated steam mixture 39 in conduit 34, its temperature generally drops to from 1000° to 1300° C. at the point where the heating gas enters the outlet duct 51. The heat supplied by the heating gas is a combination of heat by radiation and by convection. For example, about 90 percent of the heat supplied to the reactor tube 34 is by radiation from the radiation block structure 35, and the remaining part is by convection and radiation from the heating gas. The heat supplied directly from the heating gas to the reactor tube is about 4 percent radiant heat and about 6 percent convection heat, based on percent of total heat flux. As described hereafter, the excellent heat transfer by radiation from the blocks is made possible by the extended surface area of the lengthwise passage in the radiation block structures. The temperature of the reaction product will vary from about 700°-1000° C. throughout the reactor conduit 34.

As mentioned earlier, part of the heat required for the reaction is supplied adiabatically by the sensible heat of the superheated steam, while another part of the reaction heat is supplied by the heating gas, which passes through the radiation blocks and simultaneously heats both the blocks and the reactor conduit. This arrangement gives a desirable temperature profile. To be specific, the highest heat flux required for the reaction is supplied at the exact point needed, that is, immediately upon mixing of the superheated steam and hydrocarbon (at this point the heating gas has a temperaure of about 1850° C.). It is at this point that the cracking reactions proceed at the highest rate, so that the endotherm effect provides maximum cooling of the reaction. It is for this reason that very high heat fluxes are achieved in the first part of the reactor tube without exceeding the maximum tube wall temperature (skin temperature). The heating gas gradually cools from about 1850° C. at the burner, to a temperature of from about 1000°–1300° C. at the outlet, where it is discharged into the duct 51. Cooling of the heating gas in this manner thus prevents the skin temperature of the reactor tube from exceeding the maximum requirement, for example, about 1100° C.

As the reaction product enters the primary heat exchanger 47, on the shell side, it is immediately cooled to a temperaure of about 350°–750° C. by a lower temperature fluid, preferably water, which is passed through the tube side of the exchanger. This temperature is low enough to immediately stop those reactions which lead to the formation of undesirable components. The residence time in the heat exchanger is preferably no longer than about 0.03 seconds. When water is used as the lower temperature fluid, the heat transferred from the reaction product vaporizes the water, to form relatively high pressure steam. In this patent application, the primary heat exchanger 47 is described only generally and illustrated only by a schematic drawing (FIG. 1). A preferred heat exchanger is described in detail in my co-pending U.S. patent application Ser. No. 405,213, filed Aug. 4, 1982.

After the reaction product is cooled in the primary heat exchanger 47, it is discharged through the product outlet 50 and generally passed through one or more additional heat exchangers or quenchers (not shown) which are connected to the heat exchanger 47. As it passes through the secondary heat exchangers or quenchers, the reaction product is further cooled. Cooling in a heat exchanger can be accompanied by generation of steam. This is due to the vaporization of water, which is generally used as the cooling medium. Condensation of the steam, when mixed with the hydrocarbon reaction product, can give a relatively low pressure steam, which can be effectively used to produce superheated steam. Downstream from the heat exchanger(s) the final product is recovered as a hydrocarbon composition, which can contain a high proportion of ethylene.

Hydrocarbon pyrolysis reactions can cause substantial build-up of coke deposits in the reactor tubes or conduits in a relatively short period of time. To decoke the reactor of this invention, the first step is to shut off the hydrocarbon feed to the mixing device. The inlet 48 and the outlet 49 in the primary heat exchanger 47 are then closed. The next step is to drain accumulated fluid which remains in the tubes of the primary heat exchanger. Following this, superheated steam only, typically at about 1000°–1100° C., is passed from the superheater unit S through the steam line 16, mixing device 13, the reactor conduit 34, and into the primary heat exchanger 47.

As the high temperature steam passes through the reactor conduit 34 and the shell side of the primary heat exchanger 47, it removes coke deposits on the inside of the reactor conduit, on the outside of the tubes in the heat exchanger, and also on the inside of the shell housing. In some cleaning operations, the hot steam which flows out of the product outlet 50 of the heat exchanger, will be passed through one or more additional heat exchangers or quenchers (not shown) downstream of the primary heat exchanger 47. As it passes through the product outlet 50, the hot steam may be cooled by injecting water into it through a valve 52. The steam is cooled at this point to avoid damaging the tube structure in the secondary heat exchanger, since the upper temperature limit for these tubes is generally about 500° C.

The decoking operation of this invention provides distinct advantages over the usual techniques employed for decoking-cleaning of conventional hydrocarbon cracking reactors. Conventional decoking procedures usually require shutting off the hydrocarbon feed and running high temperature air (400°–800° C.) through the reactor for at least 24 hours to remove the coke. Since the furnace temperature is considerably reduced during such a cleaning operation, the metal of the reactor conduits and the furnace brickwork may be severely damaged, as a result of material contraction. In addition, because of the danger of explosion, it is often necessary to isolate both the system upstream and downstream from the furnace, to prevent oxygen from mixing with the hydrocarbon. Moreover, the exothermicity of an oxygen-coke reaction may cause local hotspots and material damage.

In contrast to the prior procedures, the cracking reactor of this invention is decoked in an on-line operation, in which only the hydrocarbon feed needs to be shut off. In addition, the whole procedure can be done in a short time, for example, about 1 to 6 hours. Another advantage is that the reactor conduit remains at normal cracking temperatures, so that there is no damage from thermal cycling. Because of the endothermicity of the steam-decoke reaction, there is no risk of overheating the reactor materials. Moreover, coke deposits are removed from the inside of the reactor conduit 34 and, in the same operation, from the outside of the tubes and the inside of the shell housing in the primary heat exchanger 47 without having to shut the system completely down for the decoking operation.

Figure 8:
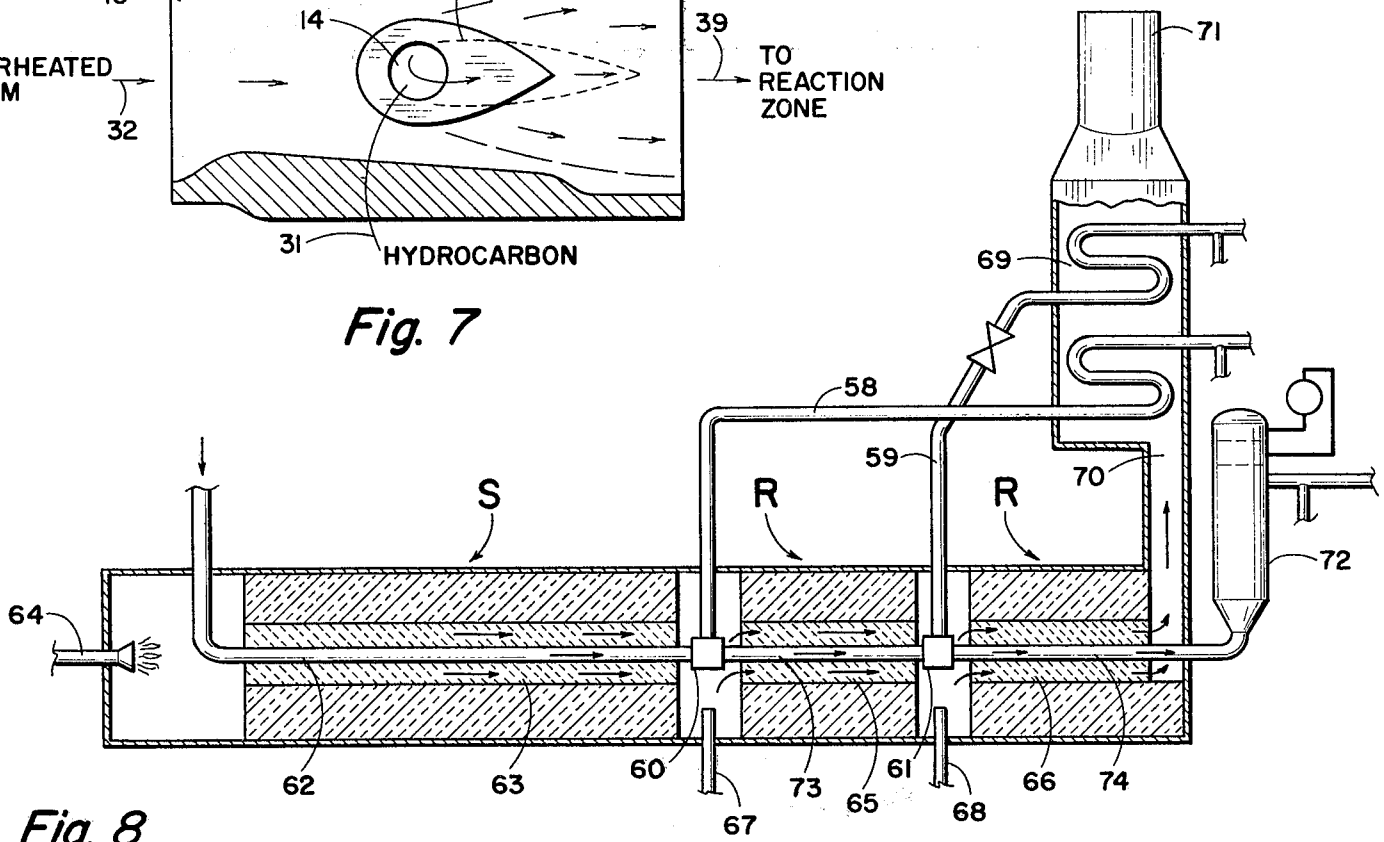
FIG. 8 is a schematic view, mostly in section, of another embodiment of the hydrocarbon cracking apparatus of this invention.

A second embodiment of the hydrocarbon cracking apparatus of this invention, which is referred to as the co-cracking apparatus, is illustrated in FIG. 8. In the co-cracking apparatus, the steam superheater S includes a steam conduit 62, which is positioned in a radiation block structure 63. In the hydrocarbon cracking apparatus illustrated in FIG. 1, the heating gas generators are positioned at various places along the steam conduit 16. In the co-cracking apparatus, however, (FIG. 8) the heating gases originate from a hot gas generator 64, which is positioned at the steam inlet side of superheater unit S. The temperature of the heating gases is adjusted to a desired value by injecting fresh fuel and air, preferably pre-heated air, along the steam line 62. In the co-cracking apparatus, therefore, the stream of heating gases flows entirely co-current with the stream of steam in line 62.

In the co-cracking apparatus, the cracking reactor unit R consists of mixing devices 60 and 61, reactor tubes 73 and 74, and radiation blocks 65 and 66. The temperature of the heating gases is increased to a desired value by the injection of fresh fuel and air, preferably pre-heated air, through the fuel injector 67 and 68. As shown in FIG. 8, the heating gases flow from radiation block structure 66 through conduit 70 to the convection section, from which they are discharged through stack 71. Alternate discharge conduits (not shown) may be provided at places where the quantity of heating gases becomes too great, for example, upstream of the mixing devices. In such an arrangement, the heating gases would be passed through the discharge conduits and directly to the convection section 69. The reaction conduit 74 is connected to heat exchanger 72 to allow the reaction product to pass to the heat exchanger and be cooled.

In the operation of the co-cracking apparatus, a lighter hydrocarbon feed and a heavier hydrocarbon feed are supplied separately through supply conduit 58 and supply conduit 59, respectively. The lighter hydrocarbon feed is preferably pre-heated to a desired temperature, for example, from about 500°-700° C. for a feed containing primarily hydrocarbons of 5 or less carbon atoms. In addition, the lighter hydrocarbon feed may be admixed with a small quantity of water or steam, but this step is optional. The ligher feed is admixed in a first mixing device 60 with superheated steam, preferably having a temperature of from about 1000° to 1500° C., and more preferably from 1100° to 1400° C. The higher steam temperatures will result in larger quantities of acetylene formation. The heavier hydrocarbon feed is preferably preheated to a desired temperature and admixed with water or steam, for example, it is heated to from about 300°-500° C. and mixed with about 10-70 percent by weight of water or steam based on the weight of the heavy hydrocarbon feed for feed containing primarily hydrocarbons of 6 of more carbon atoms.

Figure 2:
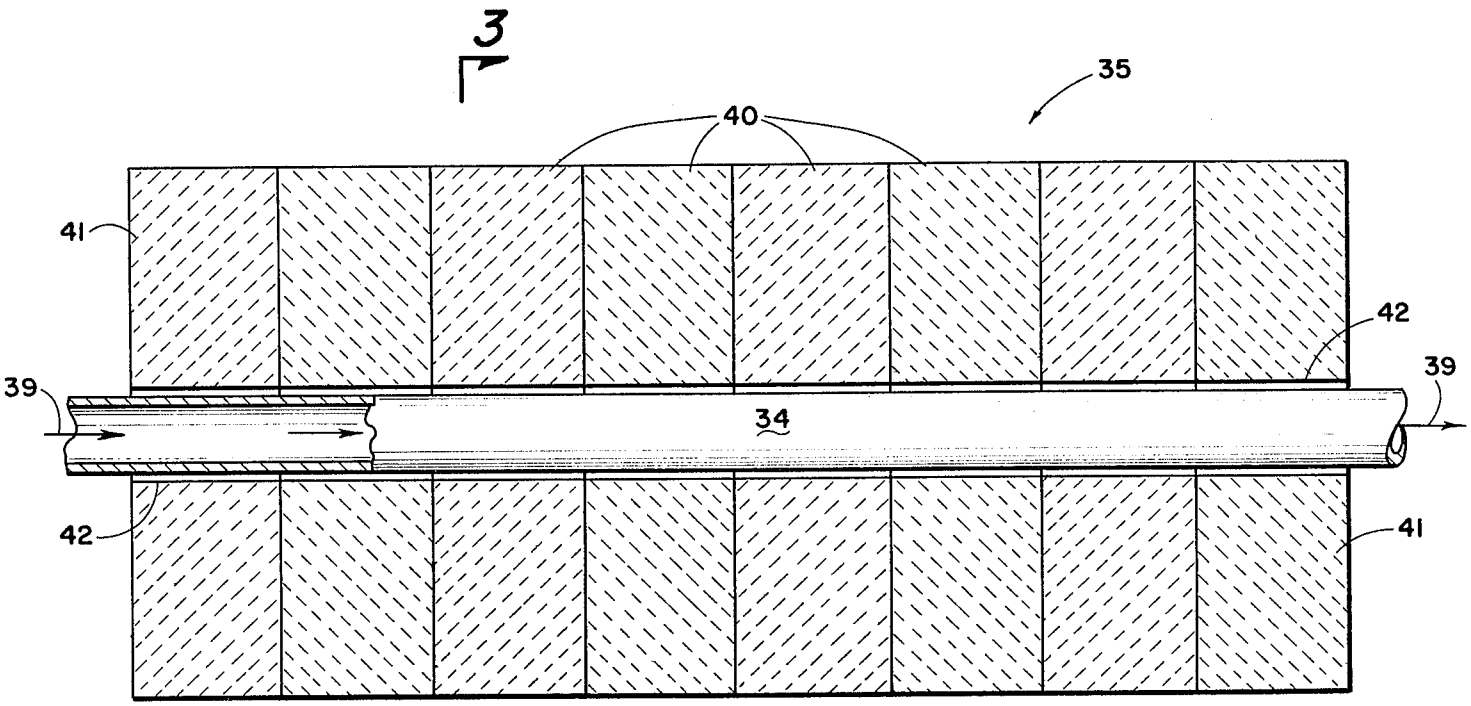
FIG. 2 is a front elevation view, mostly in section of one embodiment of a radiation block structure and a reactor conduit, which are components of the reaction zone.
Figure 3:
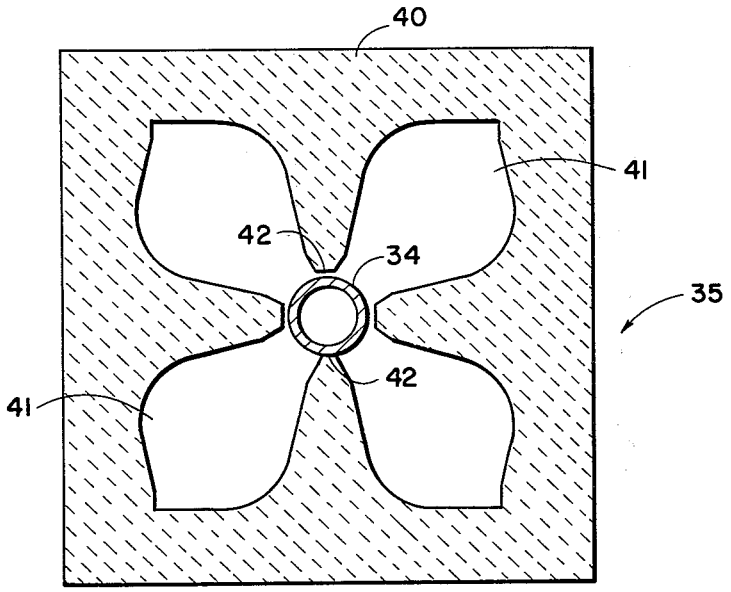
FIG. 3 is a cross-section view, taken on line 3—3 of FIG. 2.

After pre-heating, the heavier hydrocarbon is supplied at a place downstream of the first mixing device, by means of a second mixing device 61. This is an advantage because the heavier hydrocarbons require a lower cracking temperature and a shorter residence time in the reaction zone. In addition, the hydrogen deficiency of the heavier hydrocarbons, which results in the production of less ethylene, is compensated by the hydrogen transfer, via radicals, from the lighter hydrocarbon to the heavy hydrocarbon. The hot cracking gas mixture is rapidly cooled, preferably within about 0.03 seconds in the heat exchanger 72. The decoking of the cracking reactor in the primary heat exchanger is carried out in the same manner as described earlier in this text. In the practice of the present invention, the radiation block structure used in both the steam superheater S and the reaction zone R are similar. One embodiment of the radiation block structure is shown in FIGS. 2 and 3 and a second embodiment in FIGS. 4 and 5. Understandably, the invention is not limited to the specific embodiments illustrated and described in this application. The description is simplified by assuming that the radiation block structure in each embodiment is for use in the reaction zone R.

Referring to FIG. 1, the radiation block structure 35 consists of individual sections 40, each fitted tightly together by a suitable fastening means, such as a tongue and groove arrangement. As shown in FIG. 3, a passage 41 extending through the block structure 35 has the configuration, in cross-section, of a four-leaf clover. The center of passage 41 is defined by four inwardly extending projections which define inner shoulders 42. The reactor conduit 34 is positioned in the passage 41 such that the tube is supported by at least one of the inner shoulders 42 of the radiation block. With respect to the other shoulders 42, the outer wall surface of the conduit 34 is spaced a short distance from each of the shoulders. The purpose of leaving this small space between the outer wall surface of the tube 34 and some of the shoulders in the radiation block passage is to allow for creep and thermal expansion of the reactor conduit 34 under high temperature conditions, as mentioned earlier.

Figure 4:
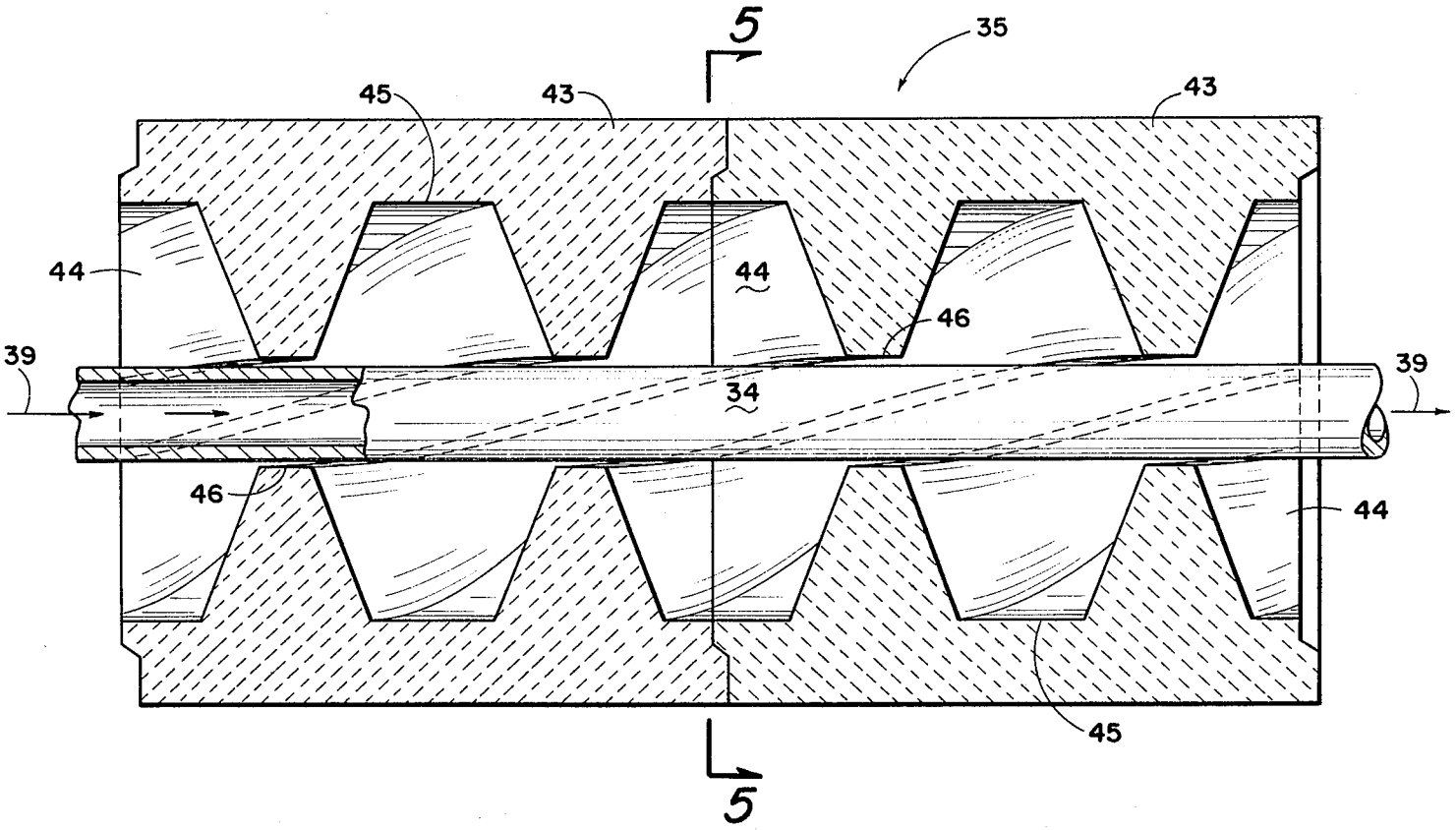
FIG. 4 is a front elevation view, mostly in section, of another embodiment of a radiation block structure and reactor conduit.

Referring to FIG. 4, the radiation block structure 35 consists of a number of individual sections 43. These pieces are also fitted tightly together by a suitable fastening means, such as a tongue and groove arrangement. A spiral passage extends lengthwise through this radiation block structure and is defined by the adjoining spaces 44. The outer limit of the passage is defined by an outside shoulder 45 in each of the spaces 44. The center of the passage is defined by inside shoulders 46, which join each of the spaces 44. As more specifically illustrated in FIG. 5, the passageway is formed by machining a four-helix opening through the radiation block structure. In this embodiment of the radiation block structure, the conduit 34 is also supported by the radiation block, but the outer wall surface of the conduit does not touch the inside shoulders 46 over the whole circumference of the tube. Instead, a small space is provided between the conduit and the shoulders, as explained earlier, to make allowance for creep and temperature expansion of the conduit during conditions of high temperature.

Figure 5:
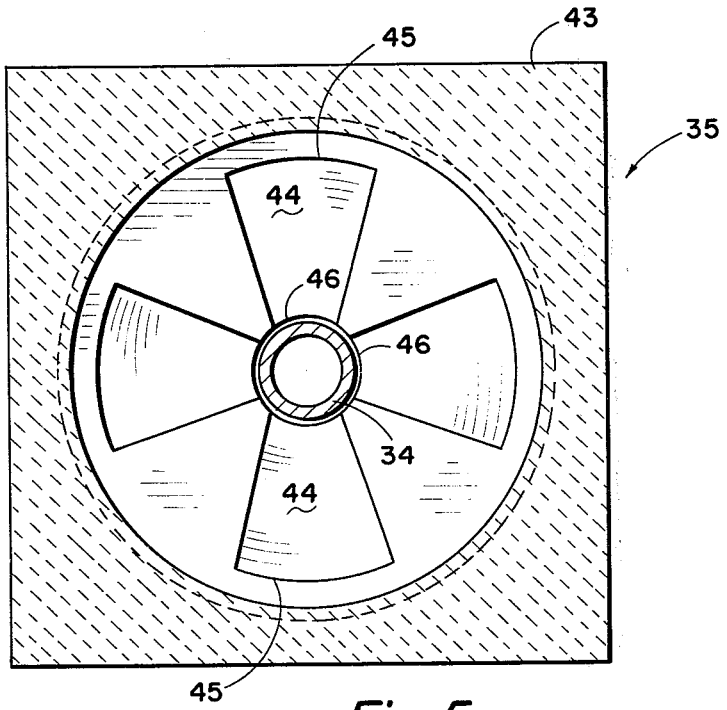
FIG. 5 is a cross-section view, taken on line 5—5 of FIG. 4.

The radiation block structure is capable of providing a large heat flux. Heat flux means the amount of heat transferred from the heating gas to the substance flowing through the conduit and can be expressed in kcal/hour/$m^2$ or watt/$m^2$. The direct heat transfer from the heating gases to the reaction conduit and the steam conduit is relatively slight. On the other hand, a large heat flux can be achieved with radiant heat from the interior surface of the radiation blocks. The amount of heat flux which the radiation blocks can provide is directly related to the configuration of the spaces 41 (FIG. 3) or the spaces 44 (FIG. 5). For this reason, a set of the radiation blocks which gives optimum heat flux can be provided by suitable selection of the configuration of these spaces. For example, a higher heat flux can be provided by enlarging the surface area of the radiation block. In fact, since a higher heat flux is desired in the vicinity of mixing device 13, the radiation blocks located near the mixing device may advantageously have a larger internal surface area than those at the opposite end of the reactor conduit.

The materials used in constructing the radiation block structure, in both the steam superheater unit and the reaction zone, are those materials which are sufficiently heat resistant to withstand the temperatures usually employed in the cracking operation. Preferred materials are ceramic compositions of the type used in high temperature refractory materials. A specific example of such a material is a ceramic composition consisting of relatively pure aluminum oxide with a chromium oxide additive to provide extra strength. Other suitable materials for the radiation block structures include magnesium oxide, zirconium oxide, thorium oxide, titanium oxide, silicon nitride, silicon carbide, and oxide fiber materials.

Generally, the reactor conduit and the steam superheater conduits are made of materials which can be produced in the desired shape, for example, tubes. In addition, these materials should be sufficiently temperature resistant to withstand the usual operating temperatures. Suitable metal compositions which may be used to fabricate the reactor tubes are nickel-based alloys of iron, chromium, cobalt, molybdenum, tungsten, and tantalum, or reinforced nickel-metal or nickel-alloy tubes. These nickel-alloy compositions can withstand temperatures as high as about 1200° C., and these compositions can also hold up under the pressure conditions inside the reactor tubes. Specifically, the preferred materials are alloys of nickel and chromium. It is also contemplated that the reactor tubes could be fabricated of ceramic compositions, such as aluminum oxide, silicon nitride, silicon carbide, or the like, to enable the tubes to withstand temperatures higher than 1200° C. Reactor tubes fabricated of these materials would enable a further reduction in the residence time, so that a higher selectivity toward the production of ethylene could be achieved. Also, the problems of material expansion at high operating temperatures would be substantially reduced.

Preferably, the ceramic materials should be transparent or translucent, so that the significant amounts of heat are transferred by radiation from the ceramic blocks and the heating gas directly to the reacting mixture. This would allow the reactor conduit to have a lower temperature, while providing a higher heat flux to the reacting mixture. In addition, coking of the reactor conduit would be reduced. The average length of the reactor conduit should be such that the residence time of the reaction product in the conduit is no longer than about 0.15 seconds. Shorter conduits are preferred to provide the desired short residence time and a desirable small pressure drop. The length should be between about 3 and 25 meters and preferably no longer than 15 meters.

The inside diameter of the conduit and the steam superheater conduit can be essentially any dimension which is desired. In actual practice, the dimensions will depend mostly on the composition of the hydrocarbon feed which is being cracked. For example, for the cracking of heavy hydrocarbons, the length of the reactor tube should be from about 3 to 10 meters, and the diameter should be such that the residence time of the reaction mixture in the reactor conduit (the reaction zone) is from about 0.005 to 0.08 seconds. Generally, a suitable reactor conduit will be a tube having an inside diameter of from about 20 to 300 mm. In actual practice, the inside diameter should be from about 50 to 150 mm, and preferably about 85 to 100 mm. At the high temperatures employed in the cracking reaction, the weight of the conduit and other external forces makes the conduits increase in length and diameter (creep and damage). Accordingly, it is preferred to continuously support the conduit in a horizontal position, to avoid the creep and damage problems.

Another feature of this invention is the capability of utilizing a wide variety of fuels to superheat the steam and to provide heat for the cracking reaction. The heating gases are produced by gas generators which can burn virtually any fuel, such as coal, lignite, heavy oils, tars, and gases, such as methane, propane, butane, and the like. Another advantage of this invention over the known systems is the precise control of the burner nozzles in the heating gas generators. The control system used herein gives a flame which is relatively pure, that is, it does not contain particles of unburned matter which can impinge on the reactor conduit and thus cause overheating of the conduit. Also, the fuel to air ratio control is much better than that of conventional natural draft furnaces, in which local differences in fuel to air ratio can occur because of an incorrect setting of the individual burners.

Figure 6:
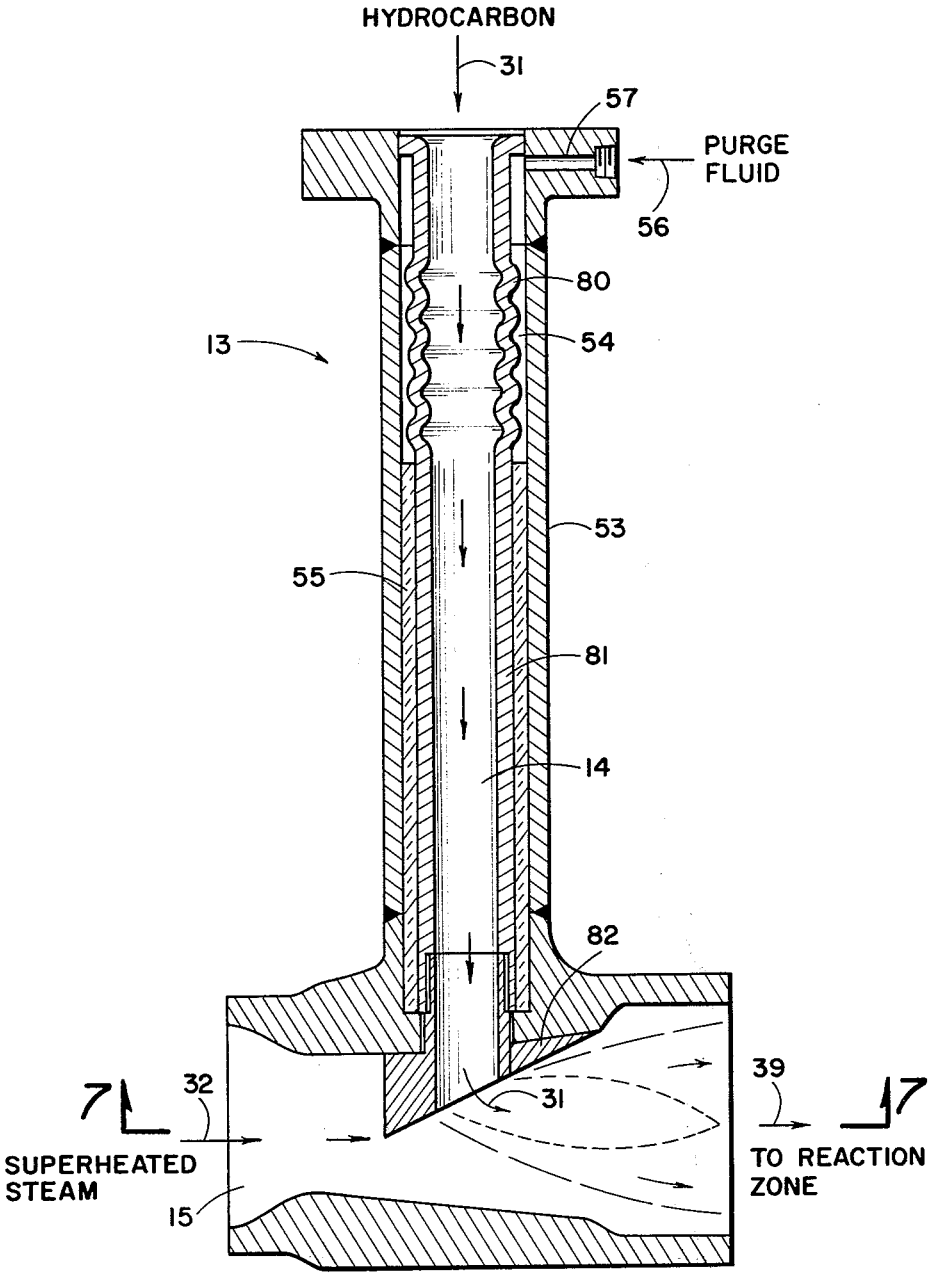
FIG. 6 is a front elevation view, mostly in section of a mixing device according to the present invention.

In the practice of this invention, the conditions are such that the hydrocarbon is intimately mixed with the superheated steam before the hydrocarbon can contact the wall of the reactor conduit. By preventing the relatively cool hydrocarbon from contacting the hot walls of the reactor conduit the formation of coke is minimized, so that more effective heat transfer is achieved throughout the reaction zone. In addition, this technique enables the temperature of the hydrocarbon to be immediately increased to the level desired for the cracking reaction. As shown in FIG. 6, the mixing device 13 includes an elongate passage 14, as defined by the interior walls of hydrocarbon delivery conduit 81. Conduit 81 carries the hydrocarbon into the bore 15 of the mixing device, where it is mixed with superheated stream. As shown, the hydrocarbon delivery conduit 81 is preferably separated from a thermal sleeve 53 by a small annular space 54. At least a portion of the space 54 is filled with a heat insulating material 55, to prevent undue temperature differences from occurring in the thermal sleeve 53. The small annular space 54 also communicates with a source (not shown) of a purge fluid, preferably steam.

Figure 7:
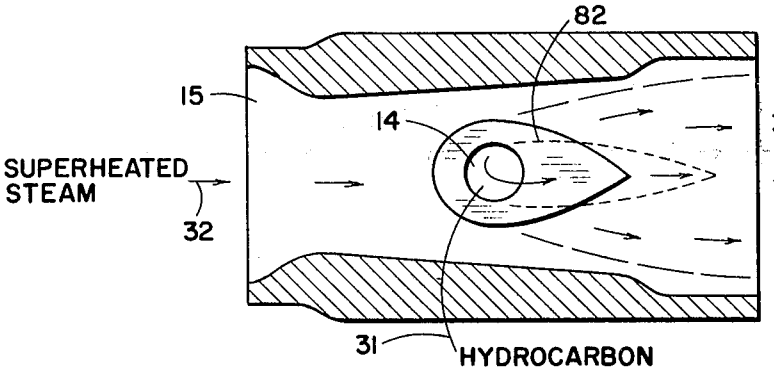
FIG. 7 is a cross-section view, taken on line 7—7 of FIG. 6.

Hydrocarbon delivery conduit 81 is equipped with an expansion joint 80, to compensate for thermal expansion in the conduit. At the outlet end of the conduit 81 is an inlet nozzle 82, which is connected to conduit 81 by a threaded connection. The inlet nozzle 82 is preferably bevelled or slanted, with the bevelled surface having a positive slope in the direction of flow of the superheated steam. This structure provides intimate and essentially immediate mixing of the hydrocarbon and superheated steam, without allowing the hydrocarbon to contact the walls of the reactor conduit 34 before the mixing takes place. More importantly, as shown in more detail in FIG. 7, the inlet nozzle has an aerodynamic shape, that is, in the shape of a teardrop, in which the round end of the nozzle 82 faces the inlet of the superheated steam, while the pointed end faces the outlet of the hydrocarbon/superheated steam mixture. In addition, the mixing characteristics are further improved by constricting the inlet for the superheated steam, so that there is an increase in the flow rate of the superheated steam as it flows past the inlet for the hydrocarbon.

In operation, the purge fluid is passed through the insulation material 55. Since the purge fluid maintains a positive pressure in annular space 54, leakage of hydrocarbon and/or steam from bore 15 through the connection of inlet nozzle 82 and conduit 81 is prevented. The purge fluid also helps to carry off convection heat in the thermal sleeve 53. The hydrocarbon from heat recovery section F flows through conduit 81 and exits from inlet nozzle 82, to be mixed with superheated steam flowing through bore 15. The flow of the superheated steam sets up a turbulence which provides immediate mixing of the steam and hydrocarbon. Mixing of the steam and hydrocarbon helps to prevent overheating of the reaction product, and it also helps to retard formation of degradation products, such as methane and coke. As mentioned earlier, another advantage of this mixing device structure is that the hydrocarbon is prevented from striking the wall of the reactor conduit, where coke deposits are most likely to form because of catalytic decomposition.

A distinct advantage of the present invention over other known processes is that a wide variety of hydrocarbon oils or gases may be employed as the hydrocarbon feed. The usual feeds are broadly classified as light hydrocarbons, such as ethane, propane, butane, and naptha; and heavy hydrocarbons, such as kerosene, gas oil and vacuum gas oil. In the practice of this invention, it is possible, for example, to use 75 to 85 weight percent of the crude oil, separated as vacuum distillation overhead product, as the cracker feed, and to use the balance, that is, the vacuum distillation bottoms products, as a fuel for the hot gas generators.

The following examples are given to illustrate the practice of this invention. These examples are not intended to limit the invention to the embodiments described herein.

The data for each example was obtained by reacting a hydrocarbon feed in a laboratory apparatus which simulates actual operating conditions present in a production-size furnace used for thermal cracking of hydrocarbon feeds. The product yield in each example is the result of a once-through run of the hydrocarbon feed. To simplify the present description, the laboratory apparatus is not illustrated or described in detail.

EXAMPLE 1

The hydrogen feed was a propane composition. The following data for this example relates to (1) the composition of the feed, (2) the process conditions for the reaction, and (3) the product yield obtained.

| Feed Composition | Weight Percent |
|---|---|
| Propane | 97.24 |
| Isobutane | 1.14 |
| N—butane | 1.62 |
| **Process Conditions** | |
| Superheated steam/hydrocarbon feed weight ratio | 1.94 |
| Steam temperature at inlet mixer | 1100° C. |
| Feed temperature at inlet mixer | 600° C. |
| Residence time (in reactor tube) | 0.1 sec. |
| Pressure (average over reactor tube) | 1.8 bar. |
| **Product Yield** | **Weight Percent** |
| Hydrogen | 2.0 |
| Methane | 28.4 |
| Acetylene | 3.0 |
| Ethylene | 45.0 |
| Ethane | 2.4 |
| Propadiene | 1.2 |
| Propylene | 6.9 |
| Propane | 2.7 |
| Butadiene | 2.3 |
| Butenes/butanes | 0.4 |
| Non-aromatics C5 + C6 | 3.5 |
| Benzene | 3.9 |
| Toluene | 0.6 |
| Styrene | 0.6 |

EXAMPLE 2

The hydrocarbon feed was a butane composition. The data relating to feed composition, process conditions, and product yields is as follows:

| Feed Composition | Weight Percent |
|---|---|
| N—butane | 70.0 |
| Isobutane | 30.0 |
| **Process Conditions** | |
| Superheated steam/hydrocarbon feed weight ratio | 1.85 |
| Steam temperature at inlet mixer | 1100° C. |
| Feed temperature at inlet mixer | 610° C. |
| Residence time (in reactor tube) | 0.1 sec. |
| Pressure (average over reactor tube) | 1.8 bar. |
| **Product Yield** | **Weight Percent** |
| Hydrogen | 1.6 |
| Methane | 26.8 |
| Acetylene | 2.2 |
| Ethylene | 39.3 |
| Ethane | 2.9 |

-continued

| | |
|---|---|
| Propadiene | 1.7 |
| Propylene | 7.7 |
| Propane | 0.2 |
| Butadiene | 2.4 |
| Butenes/butanes | 2.1 |
| Benzene | 4.7 |
| Toluene | 1.0 |
| Styrene | 0.9 |

EXAMPLE 3

The hydrocarbon feed was a naphtha composition. Data relating to feed composition, feed properties, process conditions, and product yield is as follows:

| Feed Composition | Weight Percent |
|---|---|
| N—paraffins | 31.31 |
| Iso-paraffins | 34.29 |
| Napthenes | 25.98 |
| Aromatics | 8.42 |
| **Feed Properties** | |
| Density | 0.7176 kg/dm$^3$ |
| Boiling Range: | |
| initial boiling point | 42.5° C. |
| final boiling point | 175.0° C. |
| **Process Conditions** | |
| Superheated steam/hydrocarbon feed weight ratio | 2.0 |
| Steam temperature at inlet mixer | 1100° C. |
| Feed temperature at inlet mixer | 580° C. |
| Residence time (in reactor tube) | 0.1 sec. |
| Pressure (average over reactor tube) | 1.8 bar. |
| **Product Yield** | **Weight Percent** |
| Hydrogen | 1.6 |
| Methane | 16.5 |
| Acetylene | 1.5 |
| Ethylene | 35.3 |
| Ethane | 2.9 |
| Propadiene | 1.4 |
| Propylene | 10.1 |
| Propane | 0.3 |
| Butadiene | 4.0 |
| Butenes/butanes | 1.7 |
| Non-aromatics C5 + C6 | 3.5 |
| Benzene | 7.3 |
| Toluene | 2.7 |

EXAMPLE 4

The hydrocarbon feed was a naphtha composition. Data relating to feed composition, feed properties, process conditions, and product yield is as follows:

| Feed Composition | Weight Percent |
|---|---|
| N—paraffins | 31.31 |
| Iso-paraffin | 34.29 |
| Naphthenes | 25.98 |
| Aromatics | 8.42 |
| **Feed Properties** | |
| Density | 0.7176 kg/cm$^3$ |
| Boiling Range: | |
| initial boiling point | 42.5° C. |
| final boiling point | 175.0° C. |
| **Process Conditions** | |
| Superheated steam/hydrocarbon feed weight ratio | 1.72 |
| Steam temperature at inlet mixer | 1360° C. |
| Feed temperature at inlet mixer | 580° C. |
| Residence time (in reactor tube) | 0.1 sec. |

-continued

| Pressure (average over reactor tube) | 1.8 bar. |
|---|---|
| Product Yield | Weight Percent |
| Hydrogen | 2.0 |
| Methane | 16.8 |
| Acetylene | 1.6 |
| Ethylene | 37.4 |
| Ethane | 2.8 |
| Propadiene | 1.5 |
| Propylene | 9.6 |
| Propane | 0.4 |
| Butadiene | 3.7 |
| Butenes/butanes | 2.0 |
| Non-aromatics C5 + C6 | 3.0 |
| Benzene | 7.1 |

EXAMPLE 5

The hydrocarbon feed was a naphtha composition. Data relating to feed composition, feed properties, process conditions, and product yield is as follows:

| Feed Composition | Weight Percent |
|---|---|
| N—paraffins | 31.31 |
| Iso-paraffins | 34.29 |
| Naphthanes | 25.98 |
| Aromatics | 8.42 |
| **Feed Properties** | |
| Density | 0.7176 kg/dm$^3$ |
| Boiling Range: | |
| initial boiling point | 42.5° C. |
| final boiling point | 175.0° C. |
| **Process Conditions** | |
| Superheated steam/hydrocarbon feed weight ratio | 1.2 |
| Steam temperature at inlet mixer | 1430° C. |
| Feed temperature at inlet mixer | 580° C. |
| Residence time (in reactor tube) | 0.1 sec. |
| Pressure (average over reactor tube) | 1.8 bar. |
| **Product Yield** | **Weight Percent** |
| Hydrogen | 1.8 |
| Methane | 15.5 |
| Acetylene | 1.0 |
| Ethylene | 35.1 |
| Ethane | 3.5 |
| Propadiene | 1.2 |
| Propylene | 11.7 |
| Propane | 0.5 |
| Butadiene | 4.4 |
| Butenes/butanes | 3.0 |
| Non-aromatics C5 + C6 | 3.5 |
| Benzene | 7.8 |
| Toluene | 3.4 |

EXAMPLE 6

The hydrocarbon feed was a vacuum gas oil composition. Data relating to feed properties, process conditions and product yield is as follows:

| Feed Properties | |
|---|---|
| Density | 0.9044 kg/dm$^3$ |
| Carbon (Conradson) | 0.07 weight % |
| Boiling Range: | |
| 10 volume percent | 350° C. |
| 90 volume percent | 480° C. |
| **Process Conditions** | |
| Dilution steam/gas oil feed ratio | 0.5 |
| Superheated steam/hydrocarbon feed weight ratio | 2.25 |
| Steam temperature at inlet mixer | 1100° C. |
| Feed temperature at inlet mixer | 360° C. |
| Residence time (in reactor tube) | 0.1 sec. |

-continued

| Pressure (average over reactor tube) | 1.8 bar. |
|---|---|
| Product Yield | Weight Percent |
| Hydrogen | 1.2 |
| Methane | 12.4 |
| Acetylene | 1.4 |
| Ethylene | 28.9 |
| Ethane | 1.7 |
| Propadiene | 1.2 |
| Propylene | 7.7 |
| Propane | 0.6 |
| Butadiene | 3.5 |
| Butenes/butanes | 1.8 |
| Non-aromatics C5 + C6 | 3.3 |
| Benzene | 7.5 |
| Toluene | 2.7 |
| Styrene | 0.8 |

The invention claimed is:

1. A process for cracking a hydrocarbon composition which comprises the steps of:

passing steam through a conduit enclosed by a radiation block structure, the structure defining a gas passage which surrounds the steam conduit;

flowing heating gases through the gas passage to superheat the steam to a temperature of from about 1000° C. to 1500° C.;

mixing the hydrocarbon composition with the superheated steam;

passing the resulting hydrocarbon-steam mixture through a reactor conduit which extends through and is enclosed by a radiation block structure, the structure defining a gas passage which surrounds the reactor conduit;

flowing heating gases through the gas passage, in contact with the reactor conduit, and in a direction co-current with the flow of the hydrocarbon-steam mixture through said reactor conduit, to heat said hydrocarbon-steam mixture to a temperature of from about 700° C. to 1000° C.;

causing the heated hydrocarbon composition to undergo a cracking reaction while in the reactor conduit; and passing the hot reaction product from the reactor conduit into a heat exchanger for quenching said reaction product.

2. The process of claim 1 in which the hydrocarbon composition is a light hydrocarbon composition containing primarily hydrocarbons having 5 carbon atoms or less, and the residence time in the reactor conduit of said light hydrocarbon is from about 0.06 to 0.15 seconds.

3. The process of claim 1 in which the hydrocarbon composition is a heavy hydrocarbon composition containing primarily hydrocarbons having 6 or more carbon atoms, and the residence time in the reactor conduit of said heavy hydrocarbon is from about 0.005 to 0.08 seconds.

4. The process of claim 1 in which the hydrocarbon composition, prior to the cracking reaction, is in the form of a vapor or fine mist.

5. The process of claim 1 in which the hydrocarbon composition is preheated to a temperature of from about 300° C. to 700° C., and prior to the preheating step, the hydrocarbon composition is admixed with not more than 70 percent by weight water or steam, based on the weight of the hydrocarbon composition.

6. The process of claim 5 in which the hydrocarbon composition is admixed with water or steam during the preheating step.

7. The process of claim 5 in which the hydrocarbon composition is admixed with liquid water.

* * * * *